US006037064A

United States Patent [19]

Vicovanu et al.

[11] Patent Number: 6,037,064

[45] Date of Patent: Mar. 14, 2000

[54] REVOLUTIONARY METHOD IN THE ART OF PAINTING AND DECORATIVE ART THE THREE-DIMENSIONAL ART OBJECT CREATED THEREBY

[76] Inventors: Dimitrie C. Vicovanu, 74-08 46th Ave., Flushing, N.Y. 11373; Olguta Patu, 36-33 Francis Lewis Blvd., Apt 2, Flushing, N.Y. 11358

[21] Appl. No.: 09/066,853

[22] Filed: Apr. 28, 1998

[51] Int. Cl.[7] ..... B44B 11/10; A47G 35/00

[52] U.S. Cl. ..... 428/542.2; 428/13; 428/16

[58] Field of Search ..... 428/542.2, 16, 428/3, 13

[56] References Cited

U.S. PATENT DOCUMENTS 4,044,176 8/1977 Wolinski et al. .
4,584,212 4/1986 Klein et al. .
5,345,705 9/1994 Lawrence .
5,367,801 11/1994 Ahn .
5,433,980 7/1995 Auld et al. .
5,662,970 9/1997 Noguchi .

*Primary Examiner*—Deborah Jones
*Assistant Examiner*—Jason Sawage
*Attorney, Agent, or Firm*—Barnes & Thornburg

[57] ABSTRACT

A three-dimensional visual artistic work comprising a skeletal fiber glass fabric; a first resin coating applied substantially evenly on the skeletal fiber glass fabric and cured to create a skeletal frame having two opposed substantially smooth surfaces; at least one first additional colored resin coating applied to the skeletal frame over only a portion of the skeletal frame and cured to create a portion of the three-dimensional visual artistic work; and at least one second additional colored resin coating applied to the skeletal frame after the first additional colored coating has cured to cover at least in part at least one of the first additional colored resin coating and the skeletal frame and then cured to create a portion of the three-dimensional visual artistic work.

26 Claims, 2 Drawing Sheets

REVOLUTIONARY METHOD IN THE ART OF PAINTING AND DECORATIVE ART THE THREE-DIMENSIONAL ART OBJECT CREATED THEREBY

BACKGROUND OF SUMMARY OF INVENTION

The invention relates to the creation of decorative and commercial artwork through the use of applying epoxy resin to a fiber glass screen material. The invention permits three-dimensional objects to be created as well as provides for coloring of the epoxy resin. Further, special lighting effects can be obtained through the location of lamps and LEDs with respect to the artistic work created and with the control of these lighting sources.

In the past decorative and commercial artwork has been limited by the materials used in forming the artwork. For example, the basic skeletal frame or underlying material used limits the artist in making attractive artwork. Different thin and thick papers, canvas, parchment and woven materials, etc. have normally been utilized as the underpinning for the reception of paint. The strength, texture, color and thickness of this skeletal material greatly influences the visual aspects of the art product that can be created. If the skeletal material has a heavy grain, it must either be covered over, or it will have a visual appearance in the final product. Covering-over by painting makes the created artwork less opaque and more brittle. This can affect the strength of the final product and perhaps limit the environment where the artwork can be displayed. For example, heavy brittle painting may not wear well under changing temperature conditions where expansion in response to temperature may cause aging or unacceptable contractions and expansions due to temperature cycling. For some materials, heat can even cause cracks or running of the material.

Likewise the patina of the artwork created is similarly influenced. Some materials make even smooth, unlined or etched surfaces hard to create, because of the consistency and application of the covering process the material comes out wavy or non-uniform. Some materials admit of matte finishes while others provide for a glossy appearance. Almost all materials have a texture to them providing some pebbling or stringy appearance to the artwork.

All old materials are affected by humidity which also can deteriorate the material of the skeletal matter and/or the material applied to the skeletal matter by the artist. Likewise, sunlight with its ultraviolet rays and temperature changes can cause deterioration of the artistic work.

Some artistic materials stay soft or malleable for a long period of time (e.g. oil paints) and thus limit the amount of layering that can be applied without the artistic work sagging in spots. Most materials cannot be sufficiently layered to provide real three-dimensional artworks beyond, say, a sixteenth of an inch. Materials that can be layered provide for reduction of transparency, limiting backdrop lighting as an option for artistic use therewith. Also, the skeletal material's thickness needs to be increased in order to support and handle the layering that creates the three-dimensional artwork, further limiting the ability of the artwork to be translucent for the passage of light.

The instant invention provides an art medium that allows for extensive layering without a significant reduction in translucency of the artwork created. It also permits three-dimensional creations by the addition of material on the front and back side of the skeletal frame utilized to support the artwork. The material hardens to provide a weather resistant artwork such that rain, sun and temperature changes have little effect, if any, on the created art.

The process of applying the material to the skeletal frame allows for the embedding of live items (e.g. flowers, butterflies, etc.) into the artwork, which live items are completely incased such as to fossilize the item embedded. Non-live items can also be embedded such as containers (vases used to hold fruit). LEDs can also be embedded into the applied material.

The materials applied to the skeletal matter is substantially clear in color so as to be translucent but can be colored before applying it to the skeletal matter. Since coloring of each layer of the applied material is possible, depth projection can be emphasized through variations in color of the layers. Also, if lightly colored, the layers can act as light filters for the passage of light coming from the rear of the artwork, thus varying and magnifying the number and hues of the color appearances.

The invention as contemplated has variable timing for backdrop lighting such that using a 24-hour timer could allow for changing the transmitted lighting to correspond with the sun (i.e. dark at midnight, sunrise, sunset, etc.). This timed lighting can also progress from light to light (e.g. LED to LED) to show movement of, say, the sun or moon across a sky or to give a halo or starburst effect, or in the case of a commercial art advertisement as a moving arrow, such as one finds on highway markers. If LEDs are used, they could be embedded in the artwork.

The invention also contemplates that use of front lighting of a variable or constant type for providing different three-dimensional effects from the artwork created. The front lighting can be located at any or all of the locations of: above, below, or to the sides of the artwork and with variable timed controls therefor.

In creating the artwork, the invention calls for the steps of first stretching of a fiber glass material across a frame to provide the base for the skeletal frame. A fiber glass material used is Style No. 1080-plane-20 mills from Hexcel Fabrics Corporation of Pleasanton, Colo. Next a clear resin material is applied to the stretched material. This resin material is "ARALDITE-AY-103" from CIBA GEIGY Corporation of Hawthorne, N.Y. The resin is first mixed with a hardener catalyst material "HY-956" also obtained from CIBA GEIGY Corporation. The mixture is one hundred parts resin to twenty parts hardener. The fiber glass coated material is then allowed to harden (20 minutes using an infrared heater or 3 hours at a room temperature of 70° F.). After hardening, the skeletal frame is ready for the application of the additional material to create the artistic design. The size and thickness of the skeletal frame tends to limit the amount of height of the possible buildup of layering. A frame size of a one-inch square would permit a layering thickness of up to an inch. A frame size of one square yard allows a layering thickness up to six inches, while a 5×7 square yard frame would handle layering thickness of 6 to 12 inches. In each of these above examples the impregnated, cured fiber glass would have a thickness of 2/16 inches.

To create color on the skeletal frame, a color pigment is added to a new resin mixture (same material as used to create the fiber glass) which is then applied to the frame and allowed to cure. For glossy and translucent colors, pigments are obtained from the TESTOR Corporation of Rockford, Ill. Colors for contouring (non-uniform in the material to be added) are obtained from DECART Incorporated of Morrisville, Vt.

The material to be applied to the skeletal frame can be applied through a brush, spatula, pad or modeled-like clay (after it has somewhat hardened). Also, a portion of the artwork could be first created in a mold and then secured to the skeletal frame by resin or resinous material previously attached to the skeletal frame. A liquid mold rubber silicon obtained from Romanoff International Supply Corporation of Amityville, N.Y. can be used for this off-skeletal layering by mold. For the embedding of live organisms and existing products into the artwork, the off-skeletal molding technique is most useful.

In the layering process, the artwork is cured after each layer is applied to the skeletal frame or previously applied and cured layer.

As the skeletal frame is translucent, a pattern of the artwork to be created can be laid under the skeletal frame to provide an outline for the artist.

It should further be recognized that repeated layers in the same color will cause the area so layered to be viewed darker at the front as less light will shine through, while at the side closest to a back light it will be lighter. This phenomena can also be used for edge borders which can be created dark or light dependent on the thickness of the applied material and the relative location of the light source.

The use of the above particular resin in the process provides great flexibility in the creation of artwork and is most revolutionary in the art world as it is not listed as an artist material in Ralph Meyer's ARTIST HANDBOOK OF MATERIALS AND TECHNIQUES, Viking Press, SBN 670.B665.4.

DETAILED DESCRIPTION OF THE DRAWINGS

In creating three-dimensional artworks in accordance with the invention, a skeletal frame is first created, and upon this skeletal frame, additional material is subsequently added in stages to create the finished product.

Figure 6:
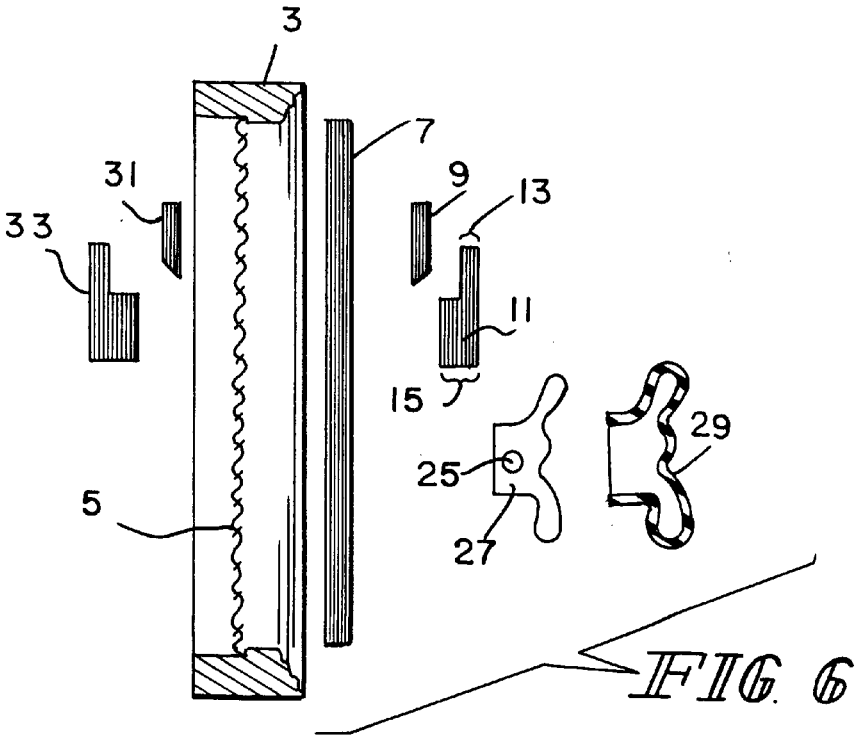
FIG. 6 is an exploded schematic of the process used to make the three-dimensional art.

FIG. 6 shows the various components of the three-dimensional artwork in an exploded view for ease of understanding of the process followed for the creation. A frame 3 normally made of wood and in a rectangular format is first created. A fiber glass fabric 5 is stretched across and attached to the frame. An acceptable fiber glass fabric for this purpose is style 1080-plane-20 mills made by Hexcel Fabrics Corporation of Pleasanton, Colo. Applied to this stretched fiber glass fabric is a first resin coating 7 (shown as a sheet in FIG. 6) but applied in a liquid form by a sponge or brush evenly over the fiber glass fabric 5. This resin coating is ARALDITE AY 103 mixed with a hardener HY 956, both manufactured by CIBA GEIGY Corporation of Hawthorne, N.Y. The mixture is 100 parts resin to 20 parts hardener. Curing of the coating fiber glass fabric takes 20 minutes using infrared heat or about 3 hours at room temperature of 70° F. This cured, coated fiber glass fabric 8 constitutes a skeletal frame for the three-dimensional artwork and is uniformly smooth and translucent and with no visible fiber network. Thus, backdrop lighting (light from behind the skeletal frame) can pass through the skeletal frame.

To obtain a three-dimensional artwork, additional layers of colored resin are sequentially applied to the skeletal frame. The additional layers are formed using the same resin mixed with color pigments. Gloss enamel and translucent color pigments from the TESTOR Corporation of Rockford, Ill. can be used, and non-uniform color for contouring can be obtained by ordering Outline Paste from DECART, Inc. of Morrisville, Vt.

After mixture of small batches of resin, hardener and color pigment, the obtained mixture is thus applied as a first coating 9 to the skeletal frame 8 by brush, spatula, sponge or molding with hands (when in a slightly gelled state). This first coating is then allowed to cure. Thereafter, additional colored coatings 11 can be applied. The FIG. 6 representation shows the additional coating as having a first thickness 13 for the portion that overlies the first coating and a second thickness 15 that overlies the skeletal foundation. This second coating can be of any color. If of the same color of its underlining base, it acts merely to enlarge the thickness. While the second coating is shown in FIG. 6 as having two different thicknesses 13 and 15, it can, of course, be of a single thickness. This additional coating is then allowed to cure. After curing, still further layers of coatings (not shown) can be added sequentially and then cured. If the layers do not overlap, plural layers can be added in the same time to the skeletal frame and allowed to cure simultaneously.

Figure 4:
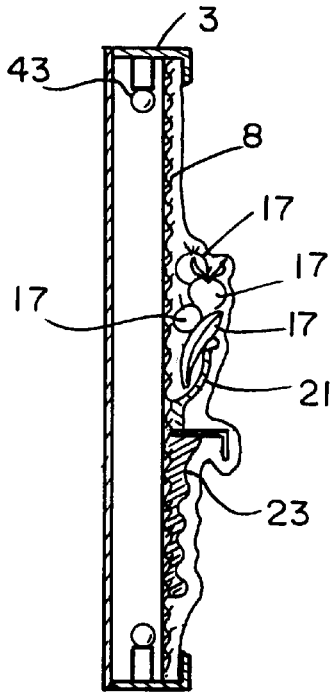
FIG. 4 is a side sectional view of still another three-dimensional artwork including embedded fruit and a portion of a fruit bowl therein.

For some artwork it is desirable to include living material 25 such as fruits 17 (FIG. 4), flowers 19 (FIG. 7), portions of manufactured objects such as half bowls 21, or partial ornate shelves 23 (FIG. 4). These materials are added to the artwork by normally first embedding them in a separate mixture 27 of the resin and hardener, which is then applied to the built-up artwork. Alternatively, a rubberized mold 29 of desired configuration can be filled with the item 25 to be embedded along with a mixture of resin and hardener and allowed to cure. The rubber for the mold can be a liquid mold silicon manufactured by Romanoff International Supply Corporation of Amityville, N.Y. After curing, the rubber mold is removed and the molded object 27 with or without an embedded object is attached to the built-up skeletal frame by the aforementioned resin hardener mixture.

While the method described so far indicates applying additional resin coatings and objects to the right-hand side of the built-up skeletal frame, layering can occur on both sides of the skeletal frame such as shown by layers 31 and 33 in FIG. 6.

Figure 1:
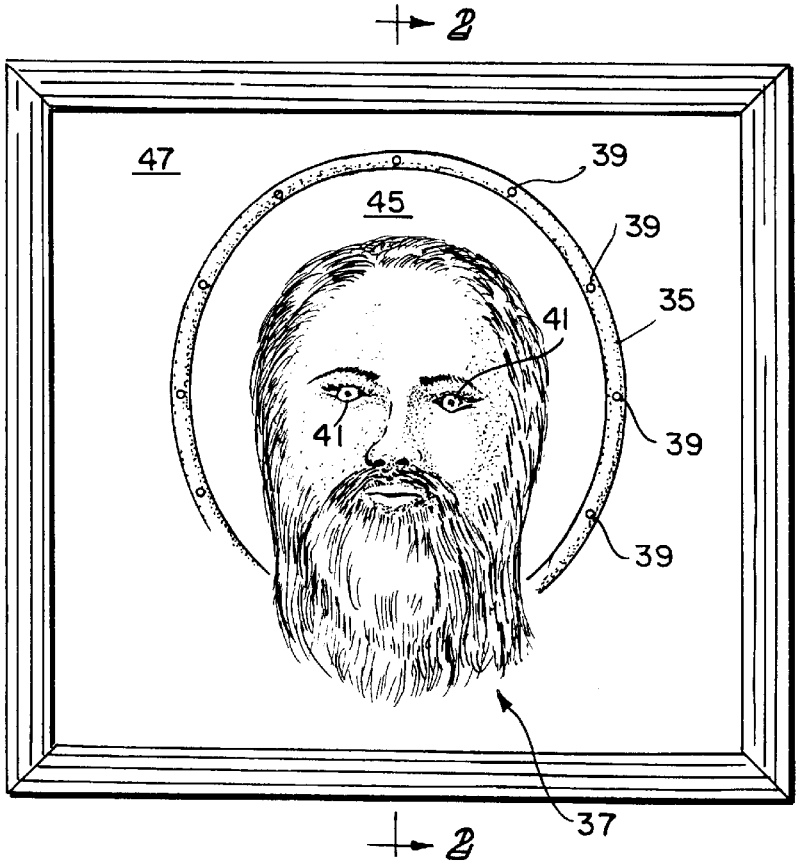
FIG. 1 is a front demonstrative view of a three-dimensional portrait of the invention.
Figure 2:
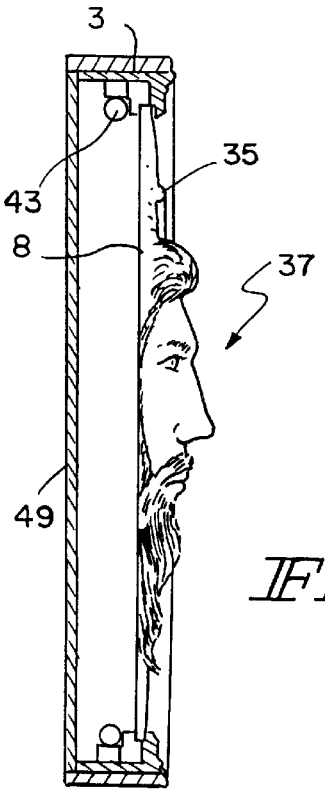
FIG. 2 is a side sectional view of the three-dimensional portrait of FIG. 1 taken along section line 2—2.
Figure 5:
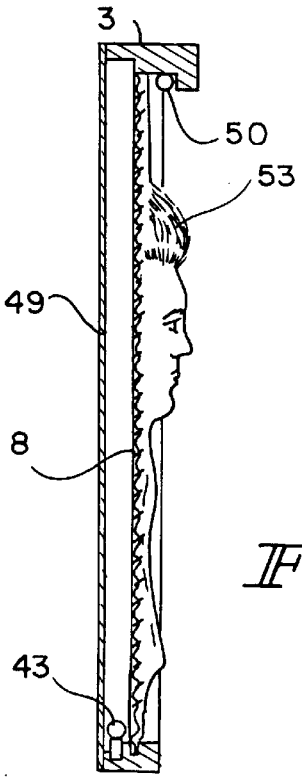
FIG. 5 is a side sectional view of still another three-dimensional artwork showing an upper bust portrait of a man.
Figure 3:
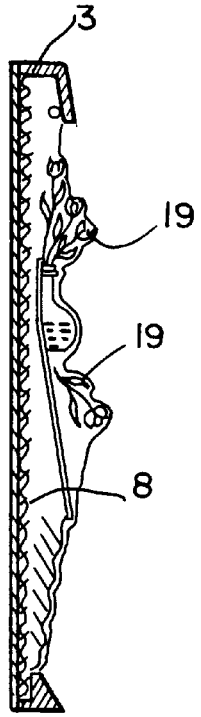
FIG. 3 is a side section view of another three-dimensional artwork including embedded flowers therein.

One of the objects that can be embedded in the resin are LEDs to provide lighting in the three-dimensional object itself Illustrative of such use can be found in the halo ring 35 around the portrait 37 of FIGS. 1 and 2. In FIG. 1, LEDs 39 are embedded into the ring 35. The LEDs can be connected to a conventional electric 24-hour timer clock to cycle the on/off periods in response to the time of the day. For example, the timer could be used to turn on the halo at dusk and turn it off at 11:00 p.m. Alternatively, the time could provide a sequence controller where the LEDs were turned on one at a time in a counter-clockwise or clockwise manner. In an artwork, the LEDs when unlit could be rather invisible and positioned in an arch across the top of the artwork. The timer could be coordinated as a noon or sun clock to sequentially operate the LEDs to shadow the path of flight of the moon or sun with respect to the earth's rotation. The eyes 41 in a portrait could have LEDs embedded therein to be lighted and enhance the animation of the art created.

Backdrop lighting 43 could be placed behind the artwork created to allow illumination from the rear. For example, the halo 35 and face 37 in FIG. 1 could be translucent with the areas 45 and 47 opaque. This would give the halo and face a brighter image in the artwork. These lights could be fluorescent or incandescent bulbs, could be colored, and could be placed adjacent any of the walls of the frame 3. A back 49 to the frame 3 could be utilized. Front light 50 at the front, at the top, bottom or sides could also be provided.

The artwork could have partially embedded items. For example, the hair 53 of a statue could be made from a textile or animal hair and allow for combing and parting by the owner. In this situation, only the roots would be ebbed. Likewise, the shelf 23 in the FIG. 4 embodiment could have its wood finish open to the outside.

The use of this resin material allows for the artwork to be relatively impervious to the weather and sunlight, thus adapting its usage for commercial art such as signage.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed:

1. A three-dimensional visual artistic work comprising:

a skeletal fiber glass fabric;

a first resin coating applied substantially evenly on the skeletal fiber glass fabric and cured to create a skeletal frame having two opposed substantially smooth surfaces;

at least one first additional colored resin coating applied to the skeletal frame over only a portion of the skeletal frame and cured to create a portion of the three-dimensional visual artistic work; and at least one second additional colored resin coating applied to the skeletal frame after the first additional colored coating has cured to cover at least in part at least one of the first additional colored resin coating and the skeletal frame and then cured to create a portion of the three-dimensional visual artistic work.

2. The artistic work of claim 1, wherein the at least first and second additional resin coatings have different coloring.

3. The artistic work of claim 1, wherein one of the at least first and second additional resin coatings is applied to a first surface of the opposed surfaces of the skeletal frame and wherein at least one additional resin coating is applied to the opposite surface of the skeletal frame.

4. The artistic work of claim 2, wherein one of the at least first and second additional resin coatings is applied to a first surface of the opposed surfaces of the skeletal frame and wherein at least one of the at least first and second additional resin coatings is applied to the opposite surface of the skeletal frame.

5. The artistic work of claim 1, wherein a molded resin object is also secured by resin to the skeletal frame to overlie a portion of at least one of the skeletal frame, the at least one first additional color coating and the at least one second additional color coating.

6. The artistic work of claim 2, wherein a molded resin object is also secured by resin to the skeletal frame to overlie a portion of at least one of the skeletal frame, the at least one first additional color coating and the at least one second additional color coating.

7. The artistic work of claim 3, wherein a molded resin object is also secured by resin to the skeletal frame to overlie a portion of at least one of the skeletal frame, the at least one first additional color coating and the at least one second additional color coating.

8. The artistic work of claim 4, wherein a molded resin object is also secured by resin to the skeletal frame to overlie a portion of at least one of the skeletal frame, the at least one first additional color coating and the at least one second additional color coating.

9. The artistic work of claim 5, wherein the resin object has imbedded therein a non-resinous object.

10. The artistic work of claim 6, wherein the resin object has imbedded therein a non-resinous object.

11. The artistic work of claim 7, wherein the resin object has imbedded there in a non-resinous object.

12. The artistic work of claim 8, wherein the resin object has imbedded therein a non-resinous object.

13. The artistic work of claim 9, wherein the non-resinous object is at least one of an LED, a plant, a ceramic object, a wooden object and a dead animal.

14. The artistic work of claim 10, wherein the non-resinous object is at least one of an LED, a plant, a ceramic object, a wooden object and a dead animal.

15. The artistic work of claim 11, wherein the non-resinous object is at least one of an LED, a plant, a ceramic object, a wooden object and a dead animal.

16. The artistic work of claim 12, wherein the non-resinous object is at least one of an LED, a plant and an insect.

17. The artistic work of claim 1, wherein the skeletal frame is mounted in a housing which contains at least one controlled electric light source located to shine a light through the at least one portion of the skeletal frame.

18. The artistic work of claim 17, wherein there are a plural of light sources which are turned on separately from one another.

19. The artistic work of claim 17, wherein there is a 24-hour timer to automatic ally set a time for the turning on and turning off of the at least one electric light sources.

20. The artistic work of claim 18, wherein there is a 24-hour timer to automatic ally set a time for the turning on and turning off of the at least one electric light sources.

21. A method of creating a three-dimensional artwork comprising the steps of forming a skeletal frame by applying a resin coating to a sketched web of fiber glass material and curing the same;

applying at least one first color resinous coating to portions of the skeletal foundation in accordance with the outline of the configuration of the three-dimensional artwork to be produced and curing same;

applying at least one second color resinous coating to the skeletal foundation with the at least one first cured coating and allowing the at least one second coating to cure to build-up on the previous at least one first resinous coating, a higher profile to obtain the three-dimensional effect.

22. The method of claim 21 farther including the separate casting of a resinous shape of material in a mold, letting the shape at least partially cure, then removing the mold and placing the resinous shape on the previously formed three-dimensional art object.

23. The method of claim 22, wherein a non-resinous object is placed into the mold while the mold is being filled.

24. The method of claim 21, wherein at least one additional resin coating is applied to the reverse side of the cured skeletal frame.

25. The method of claim 22, wherein at least one additional resin coating is applied to the reverse side of the cured skeletal frame.

26. The method of claim 23, wherein at least one additional resin coating is applied to the reverse side of the cured skeletal frame.

* * * * *